United States Patent [19]

Byford

[11] Patent Number: 4,612,844

[45] Date of Patent: Sep. 23, 1986

[54] FAIL-PASSIVE ACTUATOR CONTROL

[75] Inventor: Frank Byford, Bellevue, Wash.

[73] Assignee: The Boeing Company, Seattle, Wash.

[21] Appl. No.: 699,392

[22] Filed: Feb. 7, 1985

[51] Int. Cl.[4] ..... F15B 9/09

[52] U.S. Cl. ..... 91/363 A

[58] Field of Search ..... 91/363 R, 363 A

[56] References Cited

U.S. PATENT DOCUMENTS 3,901,128 8/1975 Swogger ..... 91/363 A X

*Primary Examiner*—Gerald A. Michalsky

*Attorney, Agent, or Firm*—Christensen, O'Connor, Johnson & Kindness

[57] ABSTRACT

An actuator of the type used in aircraft flight controls and similar applications is combined with a fail-passive electrohydraulic control system (11) that affords the usual actuator response to electrical input commands during normal operation, and responds to any of a number of possible failure conditions to dispose the actuator in a passive or neutral failure mode. The passive-failure mode allows the actuator (15) to remain in the last-known valid position or move in response to an external force such as provided by a redundant backup actuator thereby avoiding a possibly dangerous flight condition that can result from a "hard over" actuator response to a failure condition. First and second unbalanced eletrohydraulic servo actuator controls (14 and 16) are connected in back-to-back closed control loops bewteen the actuator (15) and electrical command inputs (14*e* and 16*e*) to form a balanced actuator configuration, and the separate control loops are synchronized by a synchronizing piston and associated electrical position transducer (24) that enable normal actuator operation so long as a predetermined relationship exists between the supply pressure Ps and the sum of the fluid pressure Pc1 and Pc2 applied to opposite sides of the actuator. Any failure condition results in unsynchronizing the separate control loops and equalizing the pressures at opposite sides of the actuator, thereby producing the fail-passive mode.

18 Claims, 8 Drawing Figures

FAIL-PASSIVE ACTUATOR CONTROL

BACKGROUND OF THE INVENTION

The invention pertains to servo controls for hydraulic actuators and more particularly to control systems that sense failure conditions and in response thereto assume a passive failure mode.

In the field of hydraulic control, there are numerous applications for hydraulic actuators for positioning mechanisms in response to command signals. Actuators used in certain critical environments, such as flight controls on aircraft, are often accompanied by various safety and backup systems which ideally protect against, or minimize the danger that may result from a failure of the actuator or an associated component including the fluid supply and return lines. For example, in flight controls, safety subsystems are known for counteracting "hard over" actuator commands resulting from a malfunction of one of the components or subsystems. A failure of one of the valves in a four-way valve that controls the position of an actuator may result in the actuator being driven "hard over" to one of its extreme positions. This in turn can cause the control surfaces of the aircraft to likewise be driven "hard over," flying the aircraft in an unintended and possibly dangerous direction.

To avoid this "hard over" failure mode, the usual safety systems provide for monitoring the actuator and associated controls and, if an error is detected, then backup or counteracting controls are activated to "fight" the failed actuator or the erroneous signal. These known systems typically include various electronic monitoring devices and associated electronic hardware and are themselves susceptible to a variety of possible failures. Thus, if the hydraulics of the actuator fans, and the electronic backup also fails, a "hard over" actuator condition may result because of the failure of the counteracting control or signal to neutralize the faulty command.

SUMMARY OF THE INVENTION

In accordance with the invention, a fail-passive actuator control is provided in which any one of a number of possible failure conditions causes the control system to assume a passive failure mode in which fluid pressure on opposite sides of the actuator is equalized. With zero differential pressure in the actuator it assumes a fail-passive mode in which there is no risk of a "hard over" fault condition, and yet the actuator piston is moveable in response to an external force. The control includes first and second actuator servo control loops, each having separate feedback, arranged in a back-to-back configuration and coupled between the actuator and a signal input responsive to an actuator command signal. The first servo control responds to a command signal of a given polarity and magnitude to drive the actuator to the position determined by the signal command; the second servo control likewise responds to a command signal of equal magnitude but opposite polarity to accommodate the return flow of fluid from the opposite side of the actuator, thereby cooperating with the first servo control in a balanced actuator operation.

To synchronize the operations of the first and second servo controls, a synchronizing control, in the form of a balancing piston, is coupled to receive fluid at the supply pressure Ps for forcing the balancing piston in one direction, and is coupled to passageways communicating with opposite sides of the actuator for receiving the sum of the actuator fluid pressures Pc1 and Pc2 for driving the balancing piston in the opposite direction against the supply pressure Ps. A position sensing transducer responds to the position of the balancing piston and supplies a variable synchronizing signal to the separate loops of the first and second servo controls so that as long as a predetermined ratio exists between the sum of the actuator pressures Pc1+Pc2, and the supply pressure Ps, the balancing piston will adjust to apply a signal to the separate servo controls that synchronizes their operations. Should a failure occur in any of the components or in the fluid supply or return lines, then the balancing piston detects an imbalance in the above-mentioned ratio of the sum of Pc1+Pc2 to the supply pressure Ps and becomes unable to produce a synchronizing signal of sufficient magnitude to bring these pressures into their proper relationship. Hence, the balancing piston is driven "hard over" into one of its extreme positions and the transducer output signal from the synchronization control forces the separate servo controls to couple both sides of the actuator to either supply pressure Ps or return R resulting in the fall-passive condition.

In a preferred form of the actuator control system, the synchronizing piston is provided with fluid passageways for interconnecting opposite sides of the actuator in either of the hard over conditions of the synchronizing piston. This feature ensures that the actuator pressures Pc1 and Pc2 are equalized, and the fail-passive mode is achieved, should either or both of the servo controls malfunction in a way that prevents the servo controls themselves from communicating the same pressure to both sides of the actuator.

Also in this preferred embodiment, the first and second servo controls are three-way electrohydraulic servo actuator controls each responsive to an electrical signal input as the position command. The present position of the actuator piston is sensed by separate electrical position transducers, such as linear voltage differential transformers (LVDT) devices, which suppy feedback signals to summing junctions at the inputs to the separate control loops of the electrohydraulic servo actuator controls. Similarly, the position of the synchronizing piston is sensed by an electrical transducer, such as an LVDT, and electrical signal outputs therefrom are combined at the summing junctions of the first and second servo controls with the input command and feedback signals to effect synchronism.

Thus, in the preferred embodiment, an electrohydraulic actuator control system is provided in which the actuator fails passive as the result of any single failure whether mechanical, electrical or hydraulic. When used to control such critical mechanical systems as aircraft, large industrial machine tools, road working equipment and similar systems, the fail-passive operation prevents the potentially dangerous "hard over" fault response of the actuator.

Additionally, when a fail-passive mode does occur, the system does not cause interflow from supply pressure Ps to return R, which can jeopardize the operation of other subsystems that depend on an adequate supply pressure. The system also provides actuator overload protection by automatically detecting the overload condition in the synchronizing piston which in turn initiates the fail-passive mode. By a relatively few number of reliable components, this fail-passive system eliminates the need for sophisticated and potentially unreliable electronic monitoring, modelling, switching and bypass functions which are often found in existing fail/-passive actuator controls.

BRIEF DESCRIPTION OF THE DRAWINGS

In order that the invention may be clearly understood, the preferred embodiment will now be described as one example of the invention, with reference to the accompanying drawings.

DETAILED DESCRIPTION OF THE PREFERRED EMBODIMENT

Figure 1:
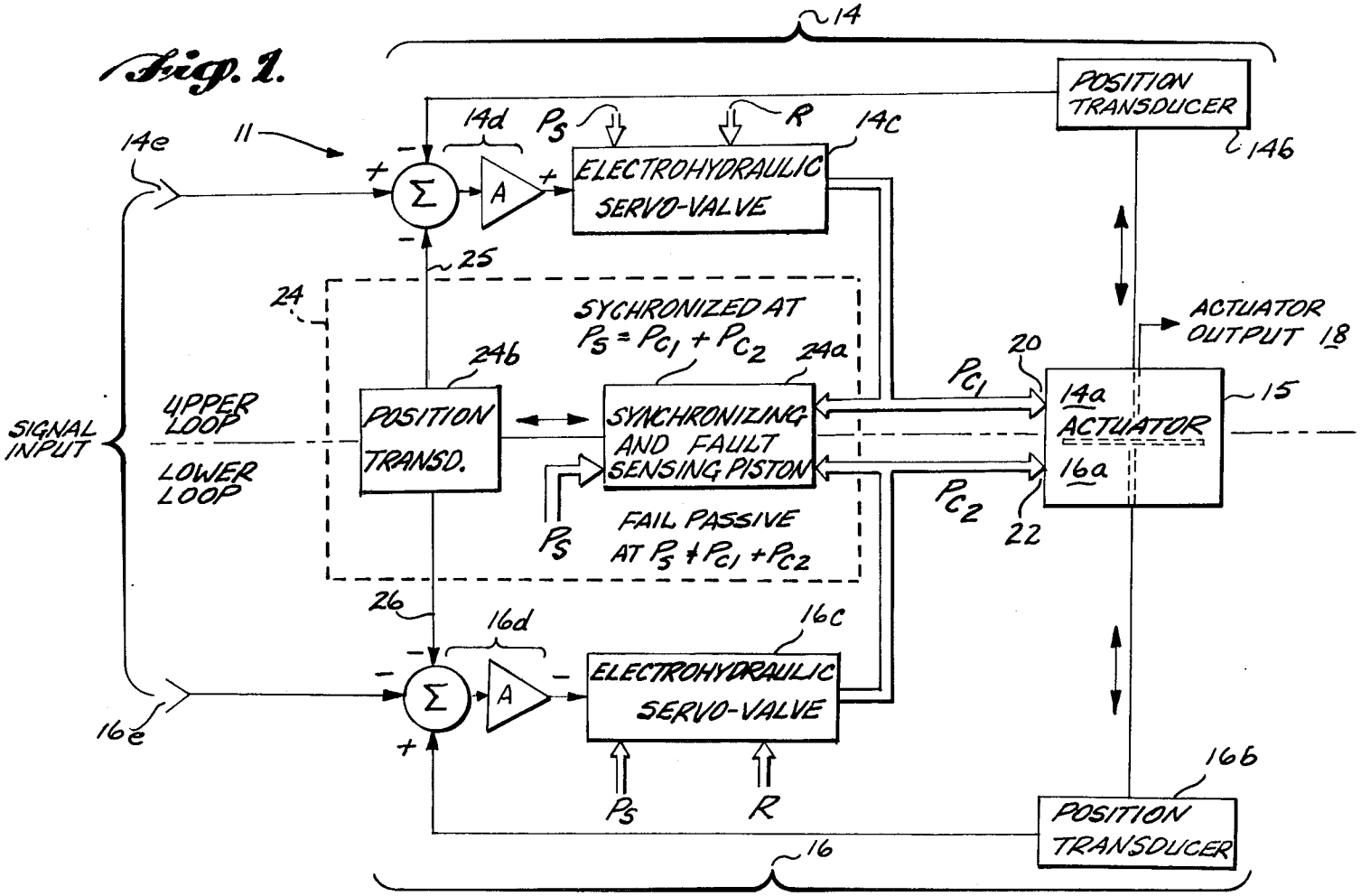
FIG. 1 is a generalized block diagram of the electrohydraulic actuator control system having the fail-passive feature.

With reference to FIG. 1, a block diagram of the actuator control system 11 is shown to include a first electrohyraulic servo control 14 comprising an unbalanced, upper closed loop subsystem for driving the actuator output 18 of an actuator 15 in one direction, and a second electrohydraulic servo control 16 comprising an unbalanced, lower closed loop subsystem for driving the actuator output in the opposite direction of movement. The separate, closed loop subsystems of controls 14 and 16 are connected in a back-to-back arrangement to form a balanced actuator control configuration for driving the common actuator output 18 in either direction to a position commanded by an input signal. Control 14 encompasses one half section 14*a* of actuator 15, a position transducer 14*b*, an electrohydraulic servo valve 14*c* and a servo amplifier 14*d* having a signal summing junction, which cofunction to supply and return fluid at a pressure Pc1 to a port 20 of section 14*a* of actuator 15 in response to an electrical command signal applied at input 14*e*. Similarly, control 16 includes the other half section 16*a* of actuator 15 having a port 22 at which fluid at pressure Pc2 enters and returns from the actuator, an actuator position transducer 16*b*, an electrolydraulic servo valve 16*c*, a servo amplifier 16*d* and an electrical signal input 16*e* for the command signal. Servo valves 14*c* and 16*c* are connected to receive fluid at a common supply pressure Ps and to a return line at a nominal return pressure R so that as one chamber actuator 15 is being filled with fluid at pressure Ps, the other side of the actuator is emptied to the return line.

An electrohydraulic synchronizing control 24 is jointly coupled to the upper and lower loop servo controls 14 and 16. During normal operation control 24 synchronizes the actions of servo valves 14*c* and 16*c* to selectively communicate fluid at supply pressure Ps and to return fluid at pressure R via actuator ports 20 and 22. In abnormal operation control 24 senses any one of a number of possible malfunctions and drives the servo valves 14*c* and 16*c* to the same hard-over position so as to equalize the fluid pressures Pc1 and Pc2 on either side of the piston of actuator 15.

For this purpose, control 24 includes a synchronizing and fault sensing piston assembly 24*a* coupled to controls 14 and 16 to receive fluid at the pressures Pc1 and Pc2 and having a port coupled to the common supply pressure Ps as shown. A position transducer 24*b* moves with a synchronizing piston in assembly 24*a* and supplies electrically isolated, but equal value feedback signals to the upper and lower loop controls 14 and 16 at the summing junctions of amplifiers 14*d* and 16*d*, respectively. The signals function during normal operation to synchronize the servo valves 14*c* and 16*c* by compensating at the signal summation points for any electrical, hydraulic or mechanical mismatches in the various system components, and function in response to a faulty condition to supply common hard-over failure control signals to servo valves 14*c* and 16*c* in a failure passive mode which, as mentioned above, equalizes the pressures Pc1 and Pc2 at actuator 15.

Figure 2:
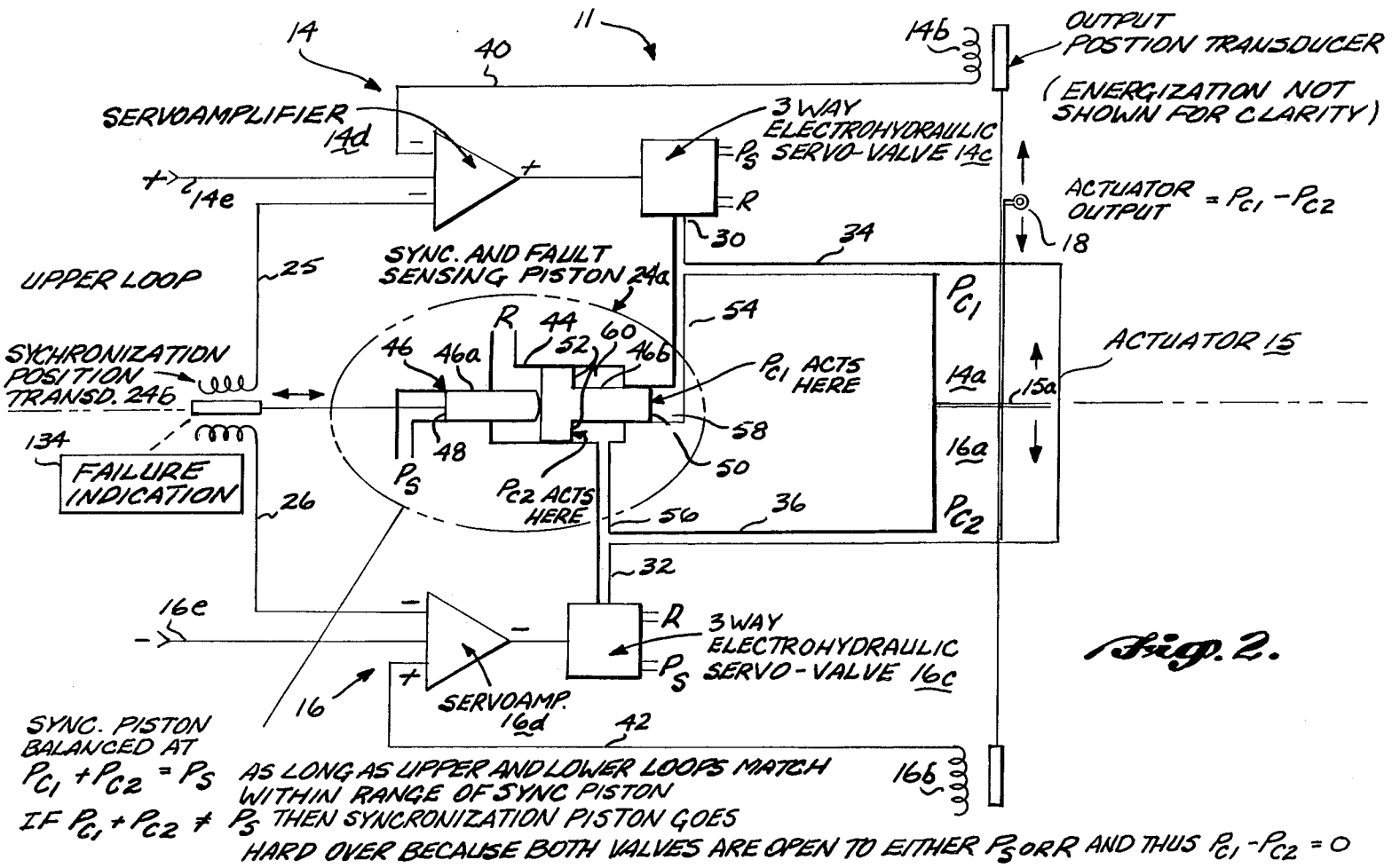
FIG. 2 is a more detailed diagram, partly schematic, of the system shown in FIG. 1.

As shown in greater detail in FIG. 2, the foregoing components of system 11 form essentially a composite four-way valve driven actuator made up of two separate three-way electrohydraulic servo valves 14*c* and 16*c* having output ports 30 and 32 for selectively communicating fluid at the supply pressure Ps and at return pressure R to the opposite chamber sections of actuator 15 via passageways 34 and 36, respectively. Each of three-way servo vavles 14*c* and 16*c* has its own closed feedback of the actuator position via transducers 14*b* and 14*c* to servo amplifiers 14*d* and 16*d*, respectively. Thus, an input command signal of, for example a positive control voltage applied to input 14*e* of the upper control loop, causes servo amplifier 14*d* to produce an error signal in the form of a positive control current at its output for in turn causing three-way servo valve 14*c* to port fluid from supply pressure Ps to its output 30 and hence via passageway 34 to the actuator chamber section 14*a*. A fluid pressure in section 14*a* of the actuator thus develops a pressure Pc1 which assumes a pressure between the supply pressure Ps and return pressure R and urging an actuator piston 15*a* downwardly, as shown in the drawing, causing a like downward movement of the actuator output 18. Assuming no resistance is encountered by fluid pressure in the lower chamber section 16*a* of the actuator, piston 15*a* and output 18 move downwardly until output position transducer 14*b* produces a negative feedback signal on conductor 40 that cancels the positive signal command applied at input 14*e*, reducing the error signal at the output of servo amplifier 14*d* to zero, and returns servo valve 14*c* to a null or neutral position blocking both the supply fluid at Ps and the return line at R from the output port 30.

A similar response occurs in the lower control loop to a negative but equal magnitude command signal applied at input 16*e*, causing servo amplifier 16*d* to produce a negative error signal that commands servo valve 16*c* to open the return line at pressure R to output port 32 and hence allowing fluid pressure at Pc2 in the chamber section 16*a* to be returned via passageway 36, port 32 and servo valve 16*c* to the return line as the actuator piston 15*a* is driven downwardly. A separate output position transducer 14*c* in the lower loop responds to the movement of the actuator output and produces a feedback signal over conductor 42 that is summed in a positive sense with the negative input command, canceling the input command and forcing the error output fromservo amplifier 16*d* to zero. Responsively, three-way servo valve 16*c* is restored to a null position, blocking both supply Ps and return R from the output port 32. This stops the outward flow of fluid from the chamber section 16*a* of actuator 15.

Since the upper and lower control loops are formed by different components, there is inevitably a mismatch in the operation of the system loops. To compensate for such mismatches, and moreover to sense a failure condition in the system, the synchronizing and fault-sensing piston assembly 24*a* is coupled to the upper and lower control loops to compare the sum of the pressures Pc1 and Pc2 in opposite sections of actuator 15 with the supply pressure Ps and to produce a compensating and fault indicating signal at an associated position transducer 24*b* that varies as a function of these pressure levels Ps, Pc1 and Pc2.

Synchronizing and fault sensing piston 24*a* is provided by an assembly of a housing 44 and a piston 46 mounted for reciprocation in housing 44 and here formed in two separate parts 46*a* and 46*b* which normally move in concert. The supply fluid at pressure Ps is communicated to a piston face 48 of predetermined area which tends to force piston part 46*a* from left to right as shown in FIG. 2 toward and against piston part 46*b*. Counteracting this piston movement is an opposite piston action created by the combination or sum of the actuator fluid pressure Pc1, acting on piston face 50 of part 46*b*, and pressure Pc2 acting on an annular surface face 52, also on part 46*b*. The fluid at pressure Pc1 is communicated to piston 24*a* from section 14*a* of the actuator via passageway 34 and a connecting passageway 54 that is connected into passageway 34 at some point between servo valve 14*c* and the actuator chamber section 14*a*. Similarly, fluid at pressure Pc2 acting on piston face 52 is communicated to the piston housing from passageway 36 and a connecting passageway 56. The configuration of piston part 46*b* and housing 44 is such that separate piston chamber 58, associated with piston face 50, and chamber 60, associated with piston face 52, are normally not connected so as to prevent interflow between the hydraulic lines of the upper and lower control loops. For non-normal operation, and as described more fully below in the preferred embodiment, piston part 46*b* is formed with internal channeling (shown in FIG. 3) for interconnecting lines 54 and 56 and hence chamber sections 14*a* and 16*a* of the actuator to neutralize differential pressure in the actuator should one of the servo valves 14*c* or 16*c* stick and fail to respond to the electrical output of position transducer 24*b* when piston assembly 24*a* is in a "hard over" failure condition. Normally, however, assembly 24*a* maintains isolation between the chambers 58 and 60 and lines 54 and 56 to block interflow between the upper and lower control loops.

Figures 3, 4:
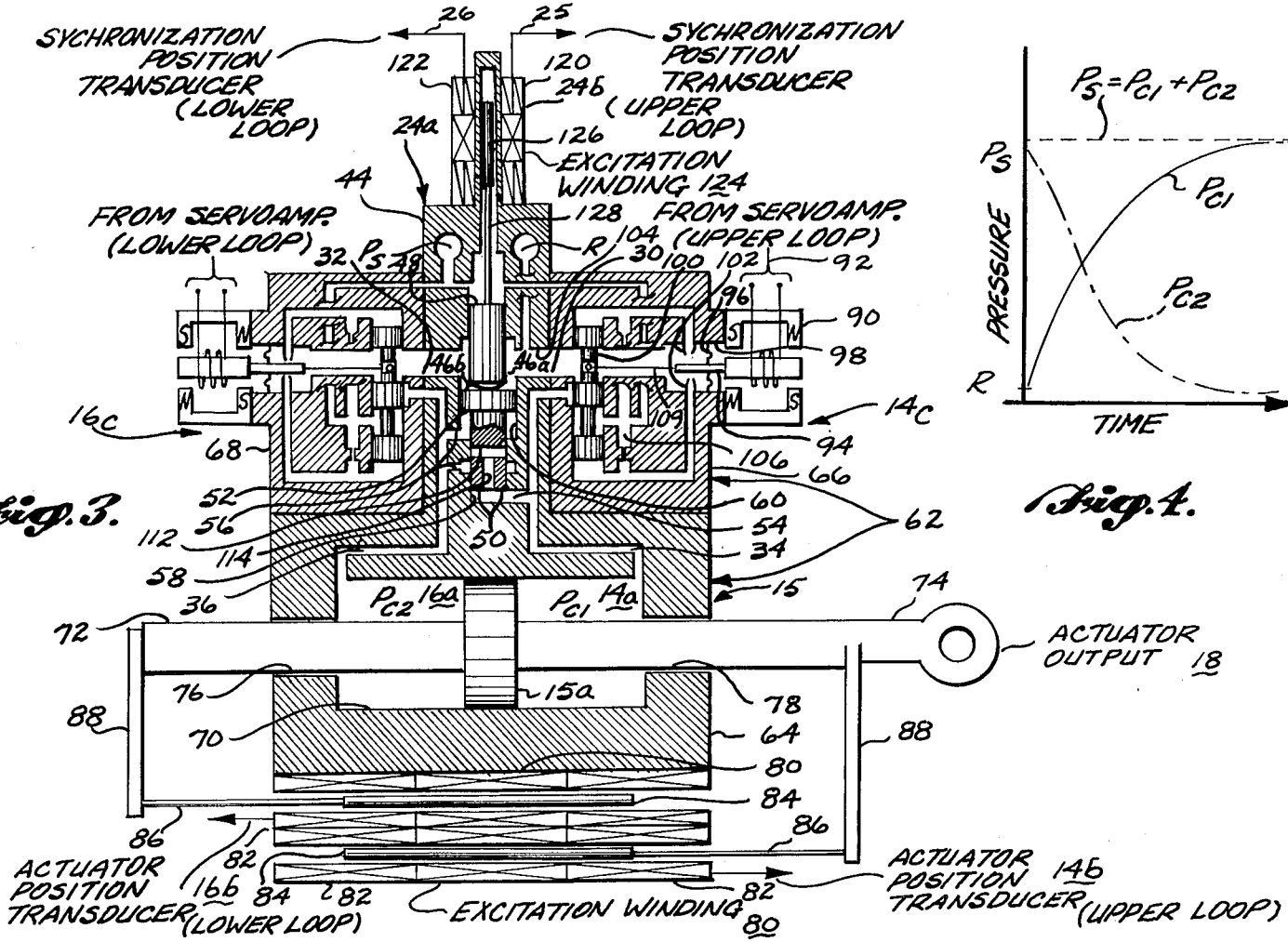
FIG. 3 is a cross-sectional view taken through a vertical plane of an assembly of the electrohydraulic servo valves, actuator and associated LVDT position transducers constructed in accordance with the preferred embodiment.
FIG. 4 is a graph showing the constant ratio between the sum of the actuator pressures Pc1 and Pc2 to the supply pressure Ps during normal operation of the actuator system.

FIG. 3 shows a preferred construction of actuator 15 and the associated output position transducers 14*b* and 16*b*, three-way electrohydraulic servo valves 14*c* and 16*c* and synchronizing and fault sensing piston assembly 24*a* and the associated position transducer 24*b*. These components are constructed and assembled as a unit including a composite housing 62 having an actuator housing section 64 in which the actuator piston 15*a* is mounted for reciprocation, servo valve housing sections 66 and 68 in which the internal components of servo valves 14*c* and 16*c* are mounted, and housing section 44 of the synchronizing and fault sensing piston assembly 24*a*. Configured in this manner, the mechanical components of the actuator system are combined into a unitary structure that can be easily mounted adjacent the location where actuator output 18 is to be connected to a controlled mechanism, such as the flight controls of an aircraft.

Housing section 64 of actuator 15 may be of any suitable shape for defining an internal cylindrical chamber 70 for cooperatively receiving the actuator piston 15*a* for bidirectional movement in response to the differential fluid pressures Pc1 and Pc2 acting on opposite piston sides. Joined to piston 15*a* are axially opposed piston stems 72 and 74 which slidably extend through openings 76 and 78 at opposite ends of housing section 64. One of the piston stems 74 provides actuator output 18 in the form of a connection lug.

While piston 15*a* and piston stems 72 and 74 are joined together for movement as a unit, separate position transducers 14*b* and 16*b* are provided to monitor this movement so as to maintain the separate electrical circuits of the upper and lower control loops, and to ensure that all possible failures associated with these transducers are communicated to the synchronizing and fault sensing piston assembly 24*a*. While a number of different types of position transducers may be used, the preferred embodiment employs LVDT transducers 14*b* and 16*b*, each being formed by excitation windings 80 and output or secondary windings 82, and elongate magnetic core probes 84. Probes 84 are supported at the ends of support rods 86 which in turn are attached to outrigger arms 88 extending transversely from piston stems 72 and 74 so that probes 84 move jointly from left to right and right to left as viewed in FIG. 3. The processed electrical output signals from these transducers are, however, of opposing phase for any given direction of movement of the actuator so as to produce the desired feedback response to the respective servo amplifiers 14*d* and 16*d* (FIGS. 1 and 2). LVDT transducers are conventional devices which receive an alternating current excitation signal at the excitation winding and produce a variable amplitude and phase change in the output or secondary winding signal in response to movement of the core probe. The output signals from the secondaries, being alternating current signals of varying magnitude, must be demodulated to produce variable level direct current control signals that appear on the electrical feedback lines 40 and 42 of FIG. 2. For clarity, the conventional excitation source and demodulation circuitry for these transducers have been omitted from this description. In the usual application of LVDTs, and in this embodiment, transducers 14*b* and 16*b* are configured so that the variable level direct current output signal is at a zero level when the associated core probe is at the null or centermost position relative to the excitation and output windings. The output signal varies in a plus or minus signal direction as the core probe moves away from the centermost null position. The null positions of transducers 14*b* and 16*b* thus correspond to the centered position of actuator 15 as it is shown in FIG. 3, with core probes 84 likewise centered.

In the preferred embodiment, two separate output position transducers are used with the actuator movement so that the failure of one output transducer unbalances the system and causes the fail-passive mode. If a single probe were used at the actuator output and the feedback signals developed by reversing the phase of one of the signals, then the loss of the common feedback signal such as caused by the breaking off of the probe core, would not necessarily unbalance the system and no failure indication would be produced. With a pair of output transducers 14*b* and 16*b*, each associated with a separate control loop, any loss or failure of one of the transducer outputs will unbalance the system and cause the synchronizing piston to shift to a hard over position.

Electrohydraulic servo valves 14*c* and 16*c* are, per se, conventional, commercially avaiable devices available from such manufacturers as Abex Corporation, Oxnard, Calif., Hydraulic Research Division of Textron, Valencia, Calif. and Moog Corp., East Aurora, N.Y. As shown in FIG. 3, these servo valves are of the two-stage, three-way electrohydraulic type which convert the level of input current flow to hydraulic flow on a proportional basis. Thus, with reference to servo valve 14*c*, an electromagnetic input assembly 90 receives an error control signal in the form of current flow at contacts 92 and drives a flapper arm 94 of assembly 90 about a pivot located at a diaphragm 96 that closes off one end of an enlarged fluid passageway 98. Flapper 94 in turn modulates a source of fluid at supply pressure Ps applied to opposed ends of a vertically reciprocating valve spool 100 by means of modulating the communication between a pair of oppositely oriented orifices 102 and a central valve chamber 104 which is connected to the return line and is at return pressure. For example, if flapper 94 is driven by the electromagnetic input to close off the upper one of orifices 102, then pressure at the upper end of spool valve 100 is increased relative to that at the lower end and the valve spool is thereby driven downwardly. A downward movement of valve spool 100 opens the output port 30 of valve 14*c* to the central passageway 104 of the assembly which is at return pressure R. Similarly, when flapper 94 closes off the lower of orifices 102, the differential pressure is greater at the lower end of valve spool 100 driving the spool upwardly and thereby communicating fluid in passageway 106 with the output port 30 of the valve.

A type of built-in feedback is provided in this electrohydraulic operation in the form of a spring wire extension 108 connecting an end of the flapper 94 to the body of valve spool 100. Whenever flapper 94 causes the valve spool to be displaced from a centermost or null position (as shown in FIG. 3) the spring wire extension 108 is deflected accordingly and tends to oppose the amount of valve movement in a way that limits the degree that the output port 30 is communicated with either the return central passageway 104 or the supply pressure passageway 106. By so limiting the valve port opening and/or closing, the output fluid flow or return tends to a level that is proportional to the magnitude of the input current signal at input contacts 92. With zero current input, the valve spool 100 assumes a null or intermediate position in which the valve output port 30 is neither connected to supply pressure Ps or return pressure R, and this null position is depicted in FIG. 3. The restrictions shown on the supply line passageway 106 provide proper piloting of the valve spool in conjunction with the flapper controlled pilot orifices 108.

Servo valve 16*c* is of an identical construction to the above-described valve 14*c*.

Servo amplifiers 14*d* and 16*d* combine the level and relative polaritites of the three input signals applied to each servo amplifier as shown in FIG. 2. For each servo amplifier the three input signals originate respectively from the command signal (at inputs 14*e* and 16*e*), from the position output transducer feedback lines (lines 40 and 42), and from the output windings of the synchronization piston transducer 24*b*. Each servo amplifier 14*d* and 16*d* has a summing junction input that sums the relative magnitudes of the three input signals in accordance with their relative polarities and produces an error signal at the amplifier output which is in the form of a current signal, which as described above, is applied to the electromagnetic input of each of servo valves 14*c* and 16*c*. The feedback signals on lines 40 and 42 are of a polarity that tends to reduce and ultimately cancel the input command signals to reduce the error signals at the amplifier outputs to zero as the actuator output 18 moves to the commanded position. When the error signal at the amplifier outputs are nulled out, the respective servo valves 14*c* and 16*c* are returned to their intermediate or null positions in which the output ports 30 and 32, respectively, are blocked from both the supply pressure Ps and the return pressure R, leaving the actuator piston and output at the commanded position.

With further reference to FIG. 3, synchronizing and fault sensing piston assembly 24*a* is mounted in a housing section 44 and includes annular piston parts 46*a* and 46*b* mounted for vertical reciprocation. Piston part 46*a* has a piston drive surface 48 disposed in a fluid chamber in communication with fluid at the supply pressure Ps and is driven downwardly as viewed in FIG. 3 by a force equal to the pressure Ps times the area of piston surface 48. A lower axial end of part 46*a* contacts piston part 46*b* and forces part 46*b* downwardly at the same force level.

Piston part 46*b* has a cylindrical body of one diameter and a relatively larger diameter head portion at the upper end of the piston part body to form an annular shoulder surface 52 which is in communication with fluid chamber 60. The lowermost end of piston part 46*b* forms a piston surface area 50 which is in communication with chamber 58. The surface areas 50 and 52, when their respective chambers 58 and 60 are pressurized, tend to drive piston part 46*b* upwardly at the sum of the applied pressure levels times the respective areas of surface 50 and 52 counteracting the downward force of piston part 48. Surface area 52 is in communication with the output port 32 from servo valve 16*c* and surface area 50 is in communication with the pressure available at the output port 30 of servo valve 14*c*. The surface areas 50 and 52 of piston part 46*b* and the surface area 48 of piston part 46*a* are selected so that during normal operation the pressures in the corresponding chambers causes the two part synchronizing piston 46 to assume a balanced, intermediate position within housing 44. More specifically, the balance is to occur when the combined pressures Pc1 and Pc2 in the actuator passageways 34 and 36 equal a constant scaling factor times the supply pressure Ps. In the preferred embodiment, the scaling factor is one so that the synchronizing piston balances at Ps=Pc1+Pc2.

Also in the disclosed and preferred embodiment, the lower piston part 46*b* is channeled internally with a cross channel 112 and an intersecting axial channel 114 opening to the sides and lower axial end of part 46*b* as shown, to cause an interconnection of passageways 34 and 36 to the actuator during certain failure conditions. Normally, supply Ps and return R are not interconnected, even during a failure condition of the actuator in order to maintain isolation between the supply and return lines. However, should a malfunction occur in which the servo valves 14*c* and 16*c*, for one reason or another, do not assume positions which equalize the pressures Pc1 and Pc2 by connecting both valve output ports 30 and 32 to either supply pressure Ps or return pressure R, then the internal channeling of piston part 46*b* will, when the synchronizing piston is driven to its hard over position, interconnect passageways 34 and 36 thereby equalizing the pressures Pc1 and Pc2. This type of malfunction may occur when one of the servo valves 14*c* or 16*c* is jammed to open one side of the actuator 15 to the return pressure R, while connecting the other side of the actuator to the supply pressure Ps. An alternative embodiment shown in FIG. 8 and described hereinafter, provides for isolation of the supply and return pressures even for the above-described malfunctions.

For convenience of manufacture, the synchronizing piston 46 is formed in the two illustrated parts. Alternatively, a single integrally formed synchronizing piston may be used.

The synchronization position transducer 24*b* is an LVDT of construction similar to that described above in connection with the actuator position output transducers 14*b* and 16*b*, except that transducer 24*b* has a pair of separate secondary windings 120 and 122 responsive to a common excitation winding 124 for producing like output position signals on leads 25 and 26 which are essentially identical, but originate from separate electrical circuits to maintain electrical signal isolation between the upper and lower control loops. The core probe 126 is mounted for reciprocation aligned with the synchronizing piston 46 and is connected to piston part 46*a* by a rod 128 that extends from piston part 46*a* through an opening in housing section 44 to the mounting location of transducer 24*b*. The output signals on leads 25 and 26 after being demodulated in accordance with the above description of LVDTs 14*b* and 16*b*, exhibits the same variable direct current polarity to inject an electrical feedback control signal of like phase and magnitude into the upper and lower servo valve loops. During normal operation, with the synchronizing piston balanced by the pressure relationships described above, the electrical control signals on leads 25 and 26 are of like phase and magnitude for forcing the separate servo valve loops to operate in synchronism but at 180° out of phase.

OPERATION

With reference to FIGS. 1 through 3, during normal operation, the upper and lower servo loops including actuator 15 function as a composite four-way electrohydraulic servo valve to drive actuator output 18 to a position commanded by the input signal. The synchronizing and fault sensing piston assembly 24 forces the separate servo loops to operate synchronously to deliver and return fluid to and from the appropriate side of actuator 15 to drive the actuator piston to the commanded position. The synchronizing function of assembly 24 can be explained this way. Any error or unbalance between the separate upper and lower servo loops 14 and 16 will result in a condition in which one servo valve will attempt to drive the actuator to one position and the other servo valve will attempt to drive the actuator to a different position. The difference in these positions represents the unbalance of the system. This unbalance can be described as a nonsynchronous operation of the separate threeway servo valves 14*c* and 16*c*.

To synchronize the operation and thereby cause the actuator to be driven to a common position, intermediate the nonsynchronous different positions described above, the synchronizing and fault sensing piston 24*a* shifts one way or another in response to the pressure ratios to produce a feedback signal on leads 25 and 26 that supplies a compensating signal to the separate servo amplifiers. The servo amplifiers in turn cause valves 14*c* and 16*c* to port fluid at supply pressure Ps to one side of the actuator 15 and return fluid from the other side to shift the actuator piston 15*a* slightly to the intermediate compromise position. In doing so the separate servo loops become synchronized and hence the term synchronization piston.

The fault sensing operation of the synchronizing piston is provided in the following manner. If a pressure or component failure occurs in one of the loops 14 or 16, the synchronizing piston becomes unbalanced because the relationshp of Pc1+PC2=PS no longer exists and the synchronizing piston 24*a* goes hard over in one or the other of its reciprocating directions. As a result, the position transducer 24*b* of assembly 24 produces offset signals of equal polarity on leads 25 and 26 which force the servo amplifiers 14*d* and 16*d* to drive their associated servo valves 14*c* and 16*c*, respectively, to connect their output ports to either supply pressure Ps or return pressure R. With both outputs connected to supply or return, the pressures Pc1 and Pc1 at opposite sides of the actuator 15 are equalized and the actuator is in a fail-passive state. The actuator is thus not forced hard over to one or the other of its extreme positions and a potentially hazardous malfunction is thus avoided. Additionally, the hard over position of the unbalanced synchronizing and fault sensing piston 24*a* positions the internal channeling 112 and 114, described above in connection with FIG. 3, to interconnected opposite sides 14*a* and 16*a* of the actuator so that the actuator can be moved in response to a force of external origin, such as provided by a parallel redundant actuator.

The proper and necessary relationship of the pressures for maintaining the synchronous operation is depicted by the graph in FIG. 4 showing the constant relationship, in normal operation, of Ps=Pc1+Pc2. Normally the supply pressure Ps will be a relatively high level and fairly constant through the actuator operation. The pressures existent at opposite sides of actuator 15 fluctuate between the relatively low return pressure R and the maximum supply pressure Ps as shown in FIG. 4, as a function of the load on the actuator output 18, with the sum of Pc1 and Pc2 being equal at all times to the supply pressure Ps. For example, the graph of FIG. 4 shows an increasing pressure Pc1 representing the application of supply pressure to the side 14*a* of actuator 15 to drive the actuator from right to left as viewed in FIG. 3. Concurrently, the pressure Pc2 in the opposite side 16*a* of the actuator is dropping from the level of the supply pressure down to the return pressure R as this side of the actuator is ported through the associated servo valve to the return line. So long as this pressure relationship of Pc1+Pc2=Ps is maintained, then the actuator operates normally to respond to the input signal commands.

Figure 5:
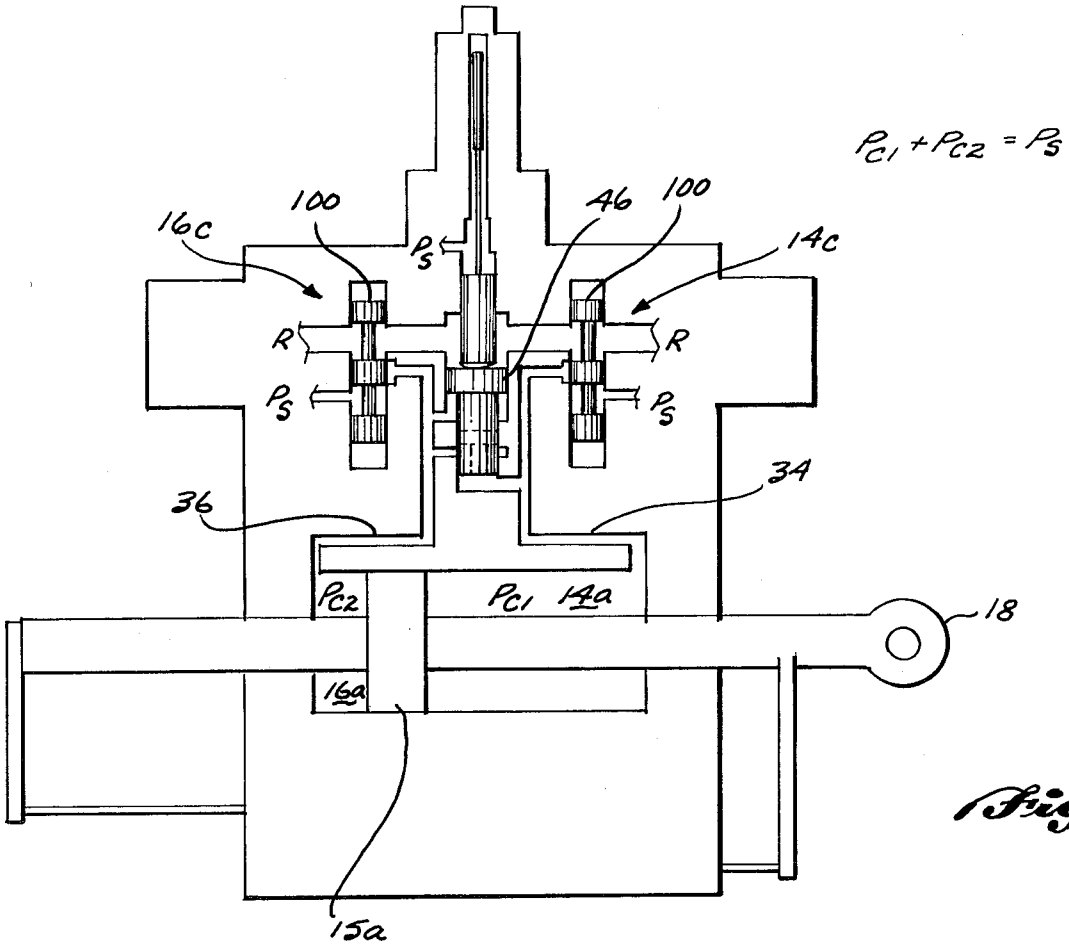
FIG. 5 is a sectional view of the servo valves and actuator shown in FIG. 3 with the cross-hatching and other detail removed for clarity, showing the relative positions of the actuator, servo valves and synchronizing piston in one exemplary and normal mode of operation.

The condition of the various servo valves and actuator during normal operation is depicted in FIG. 5. In that FIGURE, the relationship of Pc1+Pc2=Ps is satisfied and the synchronizing piston 46 assumes an intermediate, balanced position, shifted slightly one way or the other to synchronize the servo valves 14*c* and 16*c* (as described above). In this FIGURE, the valve spools of servo valves 14*c* and 16*c* have already supplied and returned the proper amount of fluid from the opposite sides 14*a* and 16*a* of the actuator to drive the actuator piston 15*a* to a position shifted to the left of center, and the valve spools have returned to their null position to maintain the actuator piston 15*a* in the position depicted, awaiting a different input command signal to change this position of the actuator.

Figure 6:
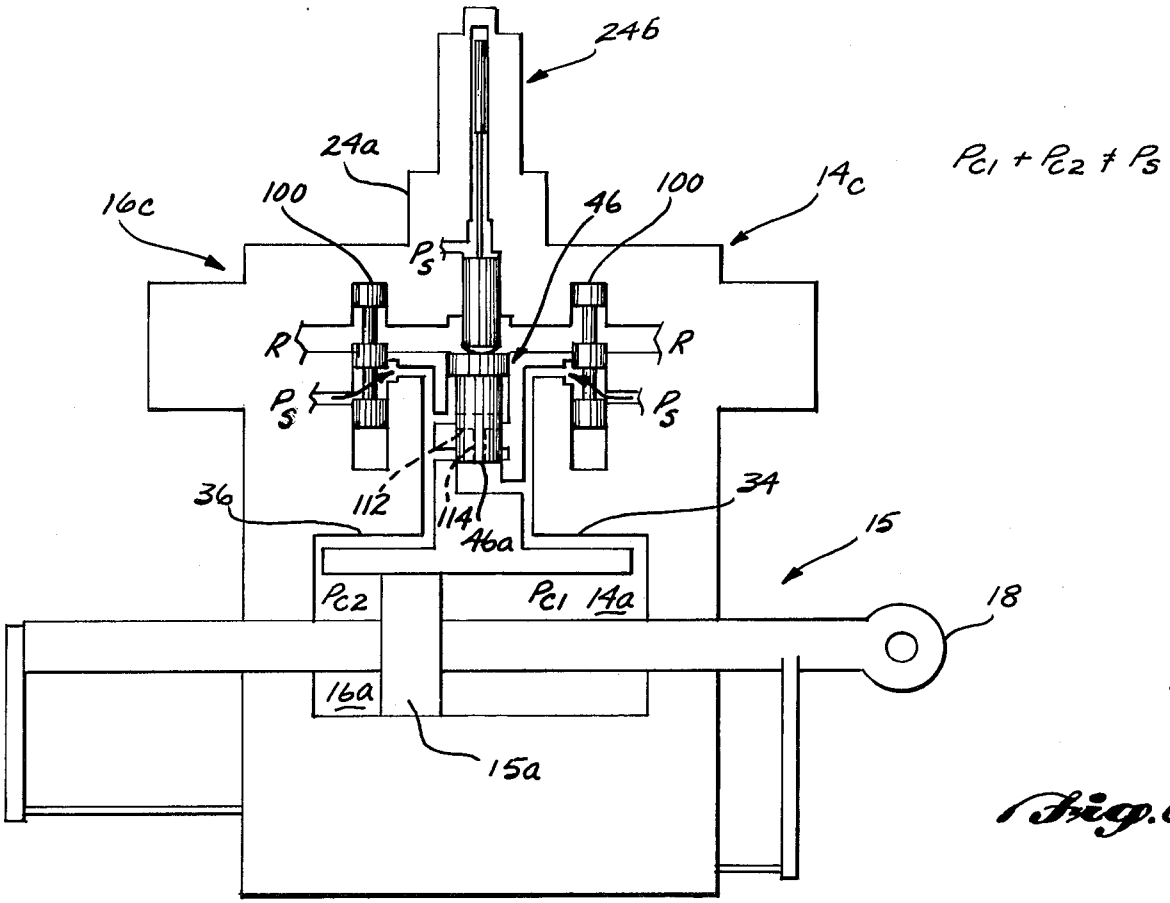
FIG. 6 is a sectional view similar to FIG. 5 except showing the positions of the servo valve spools, actuator and synchronizing piston in one of the failed passive modes.

FIG. 6 shows one of the fail-passive modes of the actuator control. In this instance, a malfunction has unbalanced the required relationship between the pressures acting on the synchronizing piston 46 such that Pc1+Pc2≠Ps, and causing piston 46 to be displaced upwardly to one of its hard over positions. This particular malfunction could be due to a number of causes, including a disruption or loss of pressure in the supply line or an overload condition on the actuator producing excessive Pc1 and/or Pc2 pressures. When the synchronizing piston 46 goes hard over as shown in FIG. 6, the output signals from transducer 24*b* force servo amplifiers 14*d* and 16*d* (FIG. 2) to drive the associated servo valves 14*c* and 16*c* to the same hard over position. The hard over position of servo valves 14*c* and 16*c* is in this case the shifting of valve spools 100 to the limit of their upward travel which ports the supply line pressure Ps to the output ports of the respective valves into the passageways 34 and 36 leading to opposite sides of actuator 15. Hence, both sides of the actuator are at the supply pressure Ps and the actuator piston 15*a* is in a fail-passive mode, remaining in its previous position, or being moved by an external force such as a force returning from the controlled mechanism at output 18, or an override force from a redundant, parallel actuator. It is observed that in this fail-passive mode, the interconnect channeling 112 and 114 in piston part 46*a* allows fluid to flow via passageways 34 and 36 from one side of the actuator to the other, accommodating the externally forced movement of actuator piston 15*a*.

Figure 7:
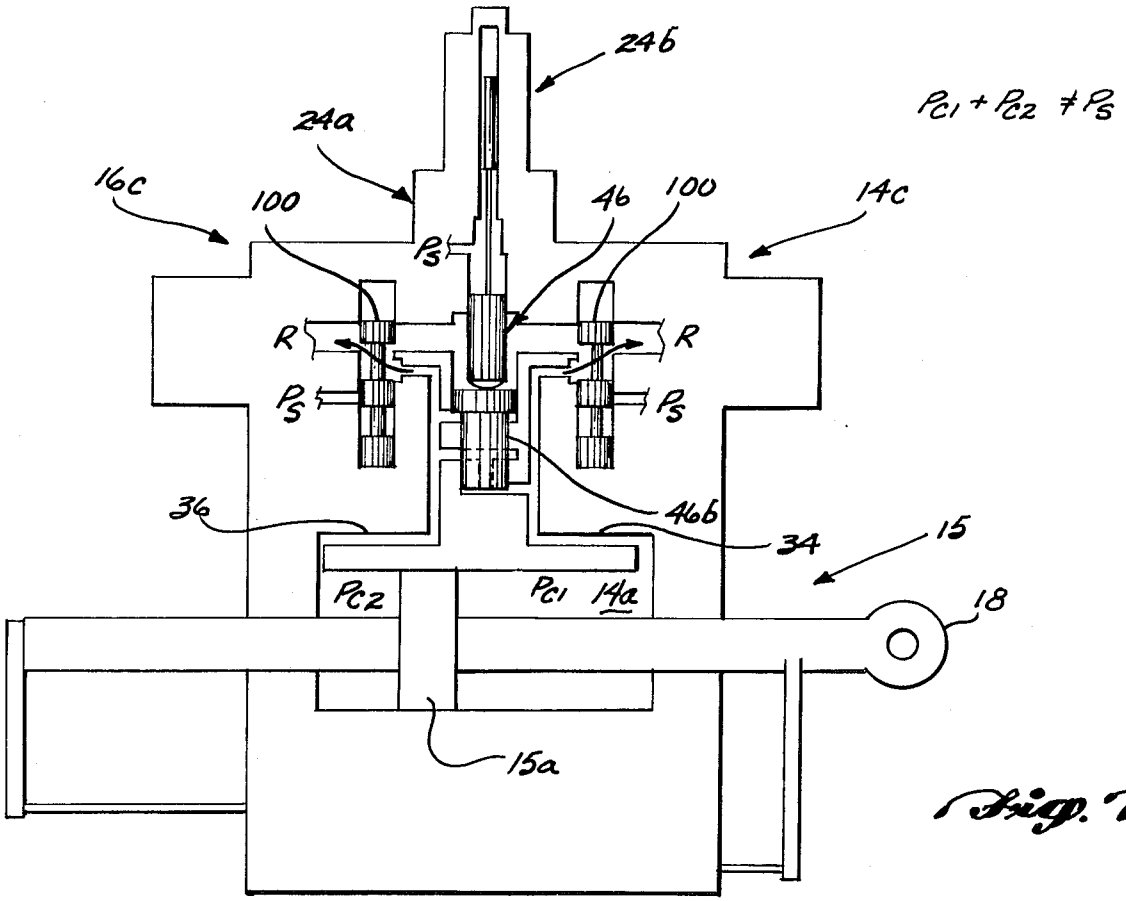
FIG. 7 is a view similar to FIGS. 5 and 6 showing the positions of the servo valve spools, actuator and synchronizing piston in another of the failed passive modes.

FIG. 7 shows still another fail-passive mode of the actuator control in which the synchronizing piston 46 has been driven to the other hard over position (compared to FIG. 6) at the downward limit of its travel. This failure, for example, could be due to a malfunction in one of the control loops which prevents the pressure on one side of the actuator piston from rising to a proper level such that the sum of Pc1+Pc2 falls short of the supply pressure Ps. In such a case, the supply pressure Ps will force the synchronizing piston 46 downwardly against the lesser value of the combined pressures Pc1 and Pc2 acting upwardly on the piston. Synchronizing piston transducer 24*b* responsively produces output signals on leads 25 and 26 (FIG. 2) which force servo amplifiers 14*d* and 16*d* to drive their respective servo valve 14*c* and 16*c* to a common hard over position. This is depicted in FIG. 7 by the displacement of valve spools 100 of servo valves 14*c* and 16*c* to their downward limit, porting the output ports of these valves to return pressure and hence connecting passageways 34 and 36 to the return lines, equalizing pressures Pc1 and Pc2 at the return pressure. This establishes the fail-passive mode of actuator 15 in which there is no net pressure difference on the opposite sides of actuator piston 15*a*, allowing the actuator to remain in its previous commanded position, or respond to an external force, such as a parallel redundant actuator.

Under most failure conditions, the supply line pressure Ps is not interconnected to the return line. Either both servo valves are driven to positions that connect both sides of the actuator to supply pressure Ps, or to return pressure R. There are, however, unusual failure conditions which do allow for interflow of fluid at Ps to return R, and vice versa, such as when one of the valve spools 100 of the servo valves jams such that the output of the synchronization transducer is unable to force that servo valve to one of the hard over positions shown in FIGS. 6 and 7. In that event, the interconnect channeling 112 and 114 in the preferred piston part 46*b*, still equalizes the pressures on opposite sides of the actuator, but may allow some interflow between Ps and R. The alternative embodiment of FIG. 8 configures piston part 46*b* so as to eliminate this possibility of interflow.

To provide an indication of a failure condition, such as a visible warning light or buzzer in the aircraft flight deck, a failure indicator 134 is provided, coupled to the synchronization position transducer 24*b* for responding to travel of the transducer core probe 126 out of the normal range beyond which synchronization is achieved (FIG. 4). Indicator 134 may be of any suitable design such as a comparator circuit for determining when the output signals on transducer leads 25 and 26 exceed a preset range, that exceeds the normal synchronization range of piston assembly 24*a* and is deemed to be in one or the other of the above-described positions. For example, normally the synchronizing piston position transducer 24*b* may produce a voltage range from −2.5 volts to +2.5 volts as the associated synchronizing piston shifts from a centermost position to synchronize the upper and lower control loops. Any output voltage from the transducer 24*b* that falls outside this range will be an indication of a failure condition, and will appear as such by the illumination of a warning light of failure indicator 134.

The input command signal applied to signal inputs 14*e* and 16*e* of the control system 11, are normally developed in two different signal channels and are substantially matched and of opposite polarity. For example, redundant flight control computer systems may be used to generate the two separate channel signals. Actually the separate signals are a composite of a single control signal that commands control system 11 to drive actuator 15 to a desired position. Thus, one computer channel may produce a command signal of +1 volts for the upper loop 14, while the other computer channel produces a command signal of −1 volts for the lower loop 16 (FIG. 2). Ideally, these signals are identical in magnitude but of opposite polarity. If the signals do not precisely agree in magnitude, then the synchronization piston assembly 24*a* will shift somewhat to balance out the error. Thus, the system is tolerant of not only mismatches in the actuator, servo valve and servo amplifier components, but also is tolerant of slight mismatches in the command signals applied to inputs 14*e* and 16*e*. While the above-described equal but opposite polarity command signals are normally used, this is not essential to the functioning of control system 11. The input command signals may be from a common signal command source.

In addition to the capability of the control to sense failure due to component malfunction and the like, control 11 also provides the important feature of providing a fail-passive condition in the event of reverse pressurization of the valve due to inadvertent crossing of the supply and return lines. Inadvertent reverse pressurization of the control will cause the synchronization and fault sensing piston assembly 24*a* to go hard over, porting opposite sides of the actuator to the return pressure R, and interconnecting the opposite sides of the actuator piston chamber to each other. Thus, the normal hard over response of an actuator to reverse pressurization is avoided.

The foregoing description is of the present preferred embodiment. Alternative configurations are contemplated.

Figure 8:
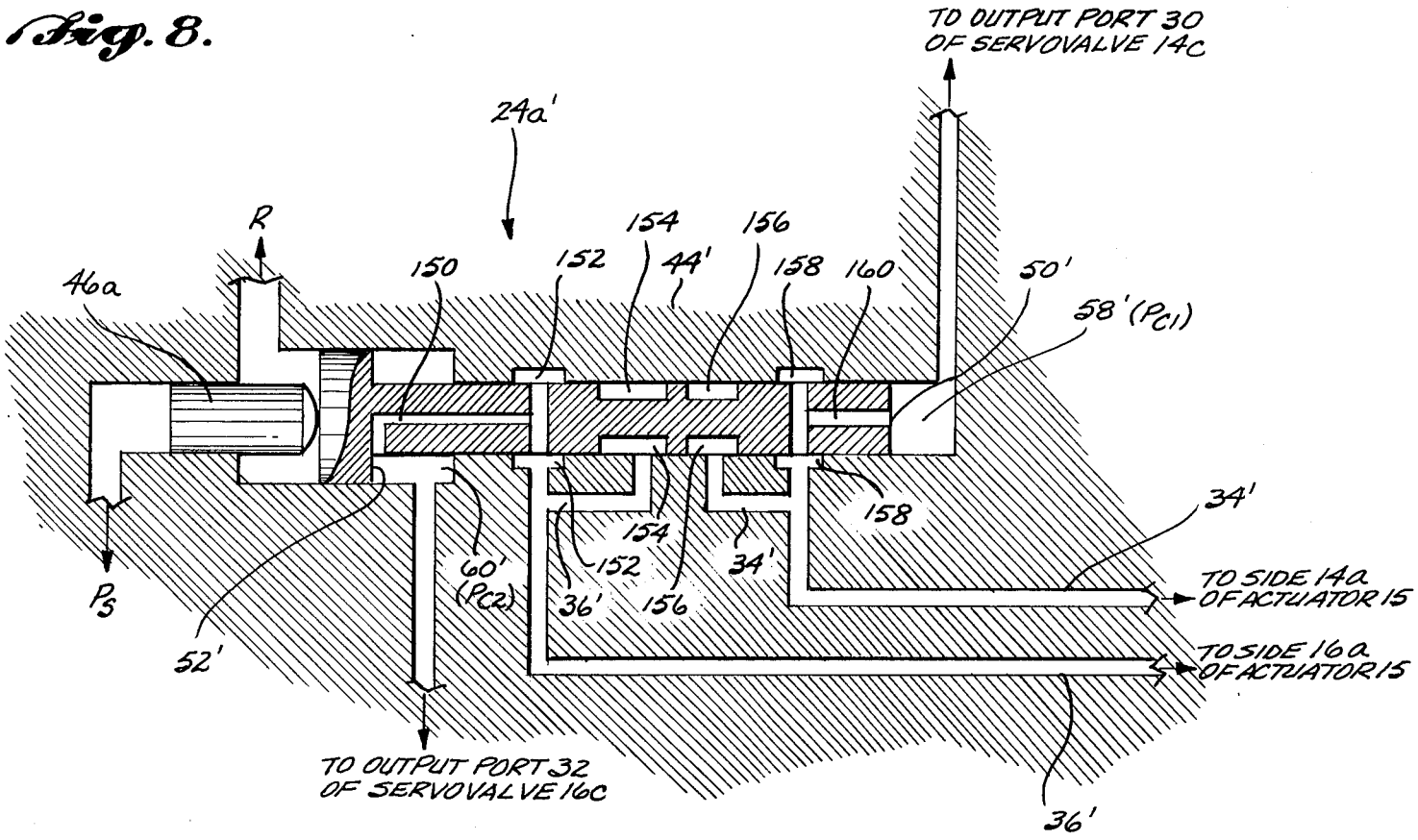
FIG. 8 is a diagrammatic view of an alternative embodiment of the synchronizing piston.

The alternative embodiment of FIG. 8 configures piston part 46*b*′ of synchronizing and fault sensing piston 24*a*′ to maintain isolation of the supply and return pressures Ps and R under all fault conditions, and still provide the fail-passive features of the invention. Piston part 46*b*′ and housing 44′ are extended to accommodate a series of annular valve grooves 152, 154, 156 and 158, which cooperate with fluid channel 150, passageways 36′ and 34′, and fluid channel 160 respectively, as follows. During normal, nonfailed synchronized operation, valve grooves 152 and 158 in housing 44′ are wide enough to communicate piston channels 150 and 160 respectively to the corresponding passageways 36′ and 34′ leading to opposite sides of the actuator 15 for those positions of piston part 46*b* within the normal, synchronization travel range. Should any malfunction occur which drives the synchronization piston out of the normal range to a hard-over fail-passive position, one or the other of annular grooves 154 and 156 on piston part 46*b*′ moves into registration with auxiliary ports 162 and 164 of passageways 36′ and 34′ coupling these passageways and hence bypassing the actuator 15. At the same time, the piston channels 150 and 160 shift out of registration, to one side or the other of grooves 152 and 158 respectively cutting off communication to servo valves 16*c* and 14*c* thereby preventing interflow of supply and return pressures.

Another modification is that the synchronization and fault sensing piston assembly 24 may be provided with biasing springs to modify the above-described pressure relationship of Pc1+Pc2=Ps, where appropriate to meet special requirements. As described above, the electrical commands applied to inputs 14*e* and 16*e*, while preferably dual-matched signals of opposite phase, can be from a single source. Energization of the position transducers 14*b*, 16*b* and 24*b*, and/or servo amplifiers 14*c*, and 16*c* can be from the same source inasmuch as lack of energization of these components results in unbalancing of the control loops since it is unlikely that these components could ever be matched perfectly without the synchronization feature provided by the synchronizing and fault sensing piston assembly 24. In other words, loss of power to these components would cause loss of the synchronizing output, which in turn would cause the system to degrade to the unbalanced state that results in the fail-passive mode. Failure indication may be provided by any number of means including the above-described indicator 34, and by such means as mechanical, electromechanical or electrooptical sensor associated with any one or more of the various transducer and valve components. The interconnect channeling provided in synchronizing piston part 46*b* may be eliminated in certain embodiments, relying on the bypassing function of the hard over conditions of servo valves 14*c* and 16*c*. Most malfunctions do not require the interconnect channeling disclosed above in the preferred embodiment, and only certain unusual malfunctions would not result in a fail-passive condition, such as when one or the other of the servo valves jams to port supply or return to one side of the actuator, while the other servo valve is driven to the opposite state.

While the preferred embodiment shows an actuator 15 having a linear movement, other types of fluid driven actuators can be used, including for example, rotary and other non-linear actuators.

Thus, only a particular embodiment has been disclosed herein, and it will be readily apparent to persons skilled in the art that numerous changes and modifications can be made thereto including the use of equivalent devices, means and method steps without departing from the spirit of the invention.

The embodiments of the invention in which an exclusive property or privilege is claimed are defined as follows:

1. An actuator control comprising:

signal input means for receiving an actuator command;

pressurized fluid supply means adapted to be coupled to a source of fluid under pressure Ps;

actuator means having first and second ports and having controlled bidirectional output in response to a fluid selectively applied to and returned from said first and second ports at pressures Pc1 and Pc2, respectively;

first and second unbalanced fluid control means each including feedback arranged with said actuator means and signal input means in a combined balanced configuration coupled to said first and second ports of said actuator means for bidirectional control of said output in response to an actuator command received at said signal input means; and, synchronization control means coupled to said first and second fluid control means and said pressurized fluid supply for synchronizing operation of said first and second fluid control means when the sum of the pressures Pc1 and Pc2 existing at said first and second ports, respectively, of said actuator means, bear a predetermined relationship to the pressure Ps of fluid at said supply means, and for sensing a failure condition when said sum of the pressures Pc1 and Pc2 does not bear said predetermined relationship to the pressure Ps and responsively causing said first and second fluid control means to assume operating modes in which the pressures Pc1 and Pc2 are equalized.

2. The actuator of claim 1 wherein said synchronization control means comprises a synchronizing and fault sensing piston means coupled to said pressurized fluid supply means for receiving fluid at pressure Ps and to said actuator means and to said first and second fluid control means for receiving fluid at the pressures Pc1 and Pc2, said synchronizing and fault sensing piston means responsive to fluid at pressure Ps to be displaced in a first direction of reciprocation, and responsive to the sum of the pressures Pc1 and Pc2 to be displaced in the other, opposite direction of reciprocation, and so that when said predetermined relationship exists among said fluid pressures, said synchronizing and fault sensing piston means assumes a balanced, synchronizing position at an intermediate position of said reciprocation.

3. The actuator of claim 2 wherein said synchronization control means further comprises position transducer means for producing synchronizing signals representing the position of said synchronizing and fault sensing piston means, said position transducer means connected to apply said synchronizing signal to said first and second fluid control means.

4. The actuator control of claim 1 wherein said feedback of each of said first and second unbalanced fluid control means comprise position transducer means coupled to said actuator means for producing a feedback signal representing the position of said bidirectional output of said actuator means; and said first and second unbalanced fluid control means each having a summing junction means coupled to said signal input means and to said position transducer means of the corresponding one of said first and second fluid control means for receiving said feedback signal.

5. The actuator control of claim 4 wherein said first and second unbalanced fluid control means each further comprise a servo valve means having fluid output means coupled to said first and second ports, respectively, of said actuator means and to said synchronization control means, and each having an error signal input means coupled to a corresponding one of said summing junction means, each of said servo valve means operating in response to error signals produced at the corresponding summing junction means as a difference between said feedback signal and said actuator command received at said signal input means.

6. The actuator control of claim 1 wherein said synchronization control means comprises a synchronizing and fault sensing piston means that moves in a path of reciprocation between travel limits in response to the levels of said pressures Ps, Pc1 and Pc2, and a position transducer means coupled to said synchronizing and fault sensing piston for producing a synchronizing signal in response to travel of said synchronizing and fault sensing piston means between said limits.

7. The actuator control of claim 1 wherein said first and second unbalanced fluid control means each comprise a three-way electrohydraulic servo actuator means connected in a closed control loop between said actuator means and said input means.

8. The actuator control of claim 1 wherein each of said first and second unbalanced fluid control means comprise:

a three-way electrohydraulic servo valve having fluid output means coupled to said actuator means and to said synchronizing and fault sensing piston means;

an electrical input for receiving an electrical error signal;

electromechanical position transducer means coupled to said actuator means and having an electrical output at which an electrical feedback signal is produced representing an output position of said actuator means; and, electrical summing junction means having an electrical error output coupled to said electrical input of said servo valve means and having a feedback input connected to said output of said position transducer means and having a command input connected to said signal input means for receiving said actuator command.

9. The actuator control of claim 8 wherein said synchronization control means comprises a synchronizing and fault sensing piston means and a position transducer means for producing an electrical synchronization signal representing a position of said synchronizing and fault sensing piston means, said position transducer means of said synchronization control means being coupled to said summing junction means of both said first and second unbalanced fluid control means so that said summing junction means combines the synchronizing signal representing the position of said synchronizing and fault sensing piston means with said actuator output position feedback signals and said actuator command signal.

10. The actuator control of claim 1 further comprising failure indicator means coupled to said synchronization control means for providing an indication of said failure condition when the sum of the pressures Pc1 and Pc2 do not bear said predetermined relationship to the supply pressure Ps.

11. The actuator control of claim 2 wherein said synchronizing and fault sensing piston means comprises fluid channel means for coupling said first and second ports of said actuator means together when said synchronization means senses said failure condition.

12. A fail passive actuator control apparatus comprising:

hydraulic actuator means for bidirectional output movement in response to pressurized fluid selectively applied to and returned from first and second ports thereof;

first and second unbalanced three-way electrohydraulic servo actuator control means including separate feedback coupled in mutually opposing relation to said first and second ports of said actuator means to form a balanced actuator configuration; and, synchronizing piston means having a movable piston acting between a supply pressure Ps and the sum of actuator pressures Pc1, and Pc2, respectively, at said first and second ports, and including synchronization position transducer means responsive to a position of said piston and having a synchronizing signal output coupled to said electrohydraulic servo actuator control means for synchronizing their operation when a predetermined relationship exists betweem the supply pressure Ps and the sum of the pressures Pc1 and Pc2, and for sensing the absence of such predetermined relationship for causing the pressures Pc1 and Pc2 at said first and second ports of said actuator means to be equalized.

13. The actuator control apparatus of claim 12 wherein said feedback of each of said first and second unbalanced servo actuator control means comprise position transducer means coupled to said actuator means for producing a feedback signal representing the position of said bidirectional output of said actuator means; and said first and second unbalanced servo actuator control means each having a summing junction means coupled to said position transducer means of the corresponding control means and to said synchronizing signal output of said synchronization position transducer and to a signal input means for receiving an actuator command.

14. The actuator control apparatus of claim 13 wherein said first and second unbalanced fluid control means each further comprise a servo valve means having fluid output means coupled to said first and second ports, respectively, of said actuator means and to said synchronizing piston means, and each having an error signal input means coupled to a corresponding one of said summing junction means, each of said servo valve means operating in response to the error signal produced at the associated summing junction as the sum of said feedback signal, said synchronizing signal and an actuator command received at said signal input means.

15. The actuator control apparatus of claim 12 wherein each of said first and second servo actuator control means comprise:

a three-way electrohydraulic servo valve having fluid output means coupled to said actuator means and to said synchronizing piston means;

an electrical input for receiving an electrical error signal;

electromechanical position transducer means coupled to said actuator means and having an electrical output at which an electrical feedback signal is produced representing an output position of said actuator means; and, electrical summing junction means having an electrical output coupled to said electrical input of said servo valve means and having a feedback input connected to said output of said position transducer means, a synchronizing input connected to said synchronizing signal output and a command input for receiving said actuator command.

16. The actuator control apparatus of claim 12 further comprising failure indicator means coupled to said synchronizing piston means for providing an indication of a failure condition when said predetermined relationship does not exist between the supply pressure Ps and the sum of the pressures Pc1 and Pc2.

17. The actuator control apparatus of claim 12 wherein said synchronizing piston means comprises fluid channel means for coupling said first and second ports of said actuator means together when said synchronization means senses the absence of said predetermined relationship.

18. An actuator control system having a fail passive operation, comprising:

electrical command signal input means for receiving an actuator command;

supply and return fluid pressure means for supplying fluid at a supply pressure Ps and returning fluid at a return pressure R;

hydraulic actuator means having a bidirectional output and first and second fluid ports for selectively receiving and returning fluid at pressures Pc1 and Pc2, respectively;

a first unbalanced three-way electrohydraulic servo actuator means connected in a closed loop between said actuator output and said input means for supplying fluid to and returning fluid from said first port thereof;

a second unbalanced three-way electrohydraulic servo actuator means connected in a closed loop between said actuator output and said input means for supplying fluid to and returning fluid from said second port thereof; and, synchronizing piston means having port means coupled to said first and second ports of said actuator means and another port means coupled to said supply and return fluid pressure means for assuming a balanced condition between a force representing the sum of the pressures Pc1 and Pc2 and a force representing the pressure Ps of said supply means, said synchronizing piston means having a position transducer including an electrical output coupled to said input means for electrically synchronizing operation of said first and second electrohydraulic servo actuator means when the sum of the pressures Pc1 and Pc2 exhibit a substantially constant ratio to the supply pressure Ps, and for causing said first and second electrohydraulic servo actuator means to couple either supply pressure Ps, or return pressure R to both said first and second fluid ports of said actuator means when said synchronizing piston means fails to sense said predetermined ratio between the sum of the pressures Pc1 and Pc2 to the supply pressure Ps.

* * * * *